US005667124A

United States Patent [19]

Bannenberg

[11] Patent Number: 5,667,124

[45] Date of Patent: Sep. 16, 1997

[54] V-SHAPED NOZZLES FOR GUIDING AND DRYING A WEB ON AN AIR CUSHION

[75] Inventor: Udo Bannenberg, Bochum, Germany

[73] Assignee: Langbein & Engelbracht GmbH & Co. KG, Bochum, Germany

[21] Appl. No.: 206,094

[22] Filed: Mar. 2, 1994

[30] Foreign Application Priority Data

Mar. 3, 1993 [DE] Germany ..... 43 06 584.8

[51] Int. Cl.[6] ..... B65H 20/14; B65H 23/24

[52] U.S. Cl. ..... 242/615.11

[58] Field of Search ..... 226/196, 197, 226/95, 97; 242/548.4, 566

[56] References Cited

U.S. PATENT DOCUMENTS

| | | | |
|---|---|---|---|
| 3,622,058 | 11/1971 | Vits | 226/7 |
| 4,200,211 | 4/1980 | Yamagishi et al. | 226/21 |
| 4,384,666 | 5/1983 | Koponen et al. | 226/97 |
| 4,785,985 | 11/1988 | Hurtgen | 226/97 |
| 4,932,140 | 6/1990 | Lepisto | 34/156 |
| 4,938,406 | 7/1990 | Nakashima et al. | 226/97 |
| 5,014,447 | 5/1991 | Hagen | 34/156 |
| 5,156,312 | 10/1992 | Kurie | 226/97 |

FOREIGN PATENT DOCUMENTS

| | | |
|---|---|---|
| 1629029 | 1/1971 | Germany . |
| 2417096 | 10/1975 | Germany . |
| 2500637 | 7/1976 | Germany . |

*Primary Examiner*—Daniel P. Stodola
*Attorney, Agent, or Firm*—Friedrich Kueffner

[57] ABSTRACT

An arrangement for the levitated guidance of a material web includes a plurality of nozzle boxes to which blowing air can be supplied. The nozzle boxes are arranged above and below the material web and are arranged one behind the other in travel direction of the material web. Each nozzle box has a nozzle plate in the form of a V-shaped trough. Two rows of openings with round blow nozzles are arranged adjacent the longitudinal edges of the nozzle plate. The axes of the round blow nozzles extend perpendicularly to the plane surface portions of the nozzle plate. The round blow nozzles are arranged in the rows of openings in such a way that the round blow nozzles of one row of openings immediately adjacent one of the longitudinal edges are arranged in a vertical transverse plane which extends between two vertical transverse planes extending through the round blow nozzles of the two rows of nozzles arranged adjacent the opposite longitudinal edge of the nozzle box.

6 Claims, 3 Drawing Sheets

V-SHAPED NOZZLES FOR GUIDING AND DRYING A WEB ON AN AIR CUSHION

BACKGROUND OF THE INVENTION

1. Field of the Invention

The present invention relates to an arrangement for the levitated guidance of a material web. The arrangement includes a plurality of nozzle boxes to which blowing air can be supplied. The nozzle boxes are arranged above and below the material web and are spaced apart from each other in travel direction of the material web. Each nozzle box has round blow nozzles which are arranged in rows of openings extending transversely of the travel direction of the material web and at the edges of the nozzle box. The blow jets emitted by the blow nozzles are inclined relative to the vertical longitudinal center planes of the nozzle boxes.

2. Description of the Related Art

The material webs in question are, for example, paper webs, such as wall paper, cardboard webs or strips of metal foil. The blowing air used for levitating the material web has several functions. On the one hand, the blowing air serves to guide the material webs without contact along the nozzle boxes. On the other hand, the blowing air serves to dry the material webs and to remove heat.

In an arrangement of the above-described type disclosed in DE-OS 16 29 029, the closed nozzle plate of each nozzle box is plane. Round blow nozzles are arranged in single rows adjacent the longitudinal edges of the nozzle box extending transversely of the travel direction of the material web. The axes of the round blow nozzles are inclined relative to the vertical longitudinal center plane of the nozzle box and intersect in an area on the side of the material web facing away from the nozzle plate. The round blow nozzles mounted in one row of openings are located in a transverse plane of the nozzle box in which the round blow nozzles of the other row of openings are also located.

This known arrangement has the disadvantage that it is comparatively difficult to manufacture because the round blow nozzles are arranged adjacent the longitudinal edges of the nozzle plates of the nozzle boxes. The known arrangement has the further significant disadvantage that the heat transfer conditions between the blowing air and the material web are not satisfactory. The reason for this disadvantage is the fact that the blowing air from the round blow nozzles is deflected at the material web almost completely at an acute angle against and in the travel direction of the material web. A space with pressurized air is formed between the material web, the nozzle plate and the blow jets. However, this pressurized air cannot result in an improvement of the heat transfer conditions.

Finally, particularly when the material webs are to be dried, unintended strips could be formed by the inclination of the axes of the round blow nozzles.

SUMMARY OF THE INVENTION

Therefore, it is the primary object of the present invention to provide an arrangement of the above-described type in which the material web, which is levitated between the nozzle boxes arranged on both sides and may be subjected to varying tensile forces, is stabilized and the heat transfer conditions are significantly improved.

In accordance with the present invention, the nozzle plate of each nozzle box facing the material web is trough-shaped in the manner of a V and at least two rows of openings with round blow nozzles are provided parallel to at least one longitudinal edge of the nozzle box. The round blow nozzles of one row of openings are offset in longitudinal direction of the rows of openings relative to the round blow nozzles of the other row of openings. The axes of the round blow nozzles provided in a plane surface portion of the trough-shaped nozzle plate extend perpendicularly to the plane surface portion. The row of openings located farthest away from the longitudinal edge of the nozzle box is located closer to the longitudinal edge than to the longitudinal center plane of the nozzle box.

The most important aspect of the present invention is the trough-shaped configuration of the nozzle plates of the nozzle boxes facing the material web, together with the specific arrangement and configuration of the round blow nozzles directly in the trough-shaped nozzle plates. This makes the manufacture of the arrangement much less difficult and, thus, the manufacture becomes less expensive. Moreover, the heat transfer from the material web to the blowing air is significantly improved. The reason for this improvement is the fact that the air which is discharged from the round blow nozzles and then widens in the form of a cone, is not only deflected at the material web against or in travel direction of the material web, depending on whether the rows of openings are arranged at the front or rear longitudinal edges of the nozzle boxes seen in travel direction of the material web, but also the trough-shape of the nozzle plate causes the space between the nozzle plate and the material web to expand in the manner of a diffuser in the transverse plane of the respective round blow nozzles, so that air can enter the space and become intensely turbulent in the space and, thus, the heat transfer is significantly improved. This turbulent air can then be discharged without problems between the bottom areas of the blow jets.

The present invention makes it additionally possible to ensure that only insignificant quantities of air can be discharged against or in travel direction of the material web at the first and last nozzle boxes seen in travel direction of the material web. This is achieved by arranging, in the first nozzle box seen in travel direction of the material web, the rows of openings at the forward longitudinal edge of the nozzle box seen in travel direction of the material web, while, in the last nozzle box seen in travel direction of the material web, the rows of openings are arranged along the rear longitudinal edge of the nozzle box seen in travel direction of the material web.

The most important advantage of the present invention is the fact that it provides excellent drying conditions for the material web and the material web, which is subjected to varying tensile forces, completely automatically assumes the optimum distance relative to all nozzle plates. This may lead to the result that the material web levitates through the arrangement in an elongated wave shape, particularly a sinusoidal shape. In this case, the nozzle boxes above and below the material web are offset relative to each other in longitudinal direction of the material web. This prevents the undesirable fluttering effect of the material web which, as is well known, leads to turning or folding, or sometimes even rupture of the material web.

Experiments have shown that best results are obtained if the plane surface portions of the trough-shaped nozzle plates provided with the round blow nozzles are inclined relative to the horizontal at angle of eight degrees to twelve degrees, preferably about 10 degrees.

A further improvement of the heat transfer conditions is achieved if, in accordance with a further feature of the present invention, at least two rows of openings with round blow nozzles are provided along both longitudinal edges of each nozzle box.

In accordance with another feature, when the nozzle box is provided with four rows of openings, the round blow nozzles of a row of openings located immediately adjacent a longitudinal edge of the nozzle box each extend in a vertical transverse plane which is located between two vertical transverse planes extending in longitudinally adjacent round blow nozzles in the rows of openings located adjacent the other longitudinal edge of the nozzle box.

In accordance with another feature of the present invention, the distance between two round blow nozzles in one row of openings corresponds to approximately three times to five times, preferably four times, the diameter of the round blow nozzles.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there is described a preferred embodiment of the invention.

DESCRIPTION OF THE PREFERRED EMBODIMENT

Figure 1:
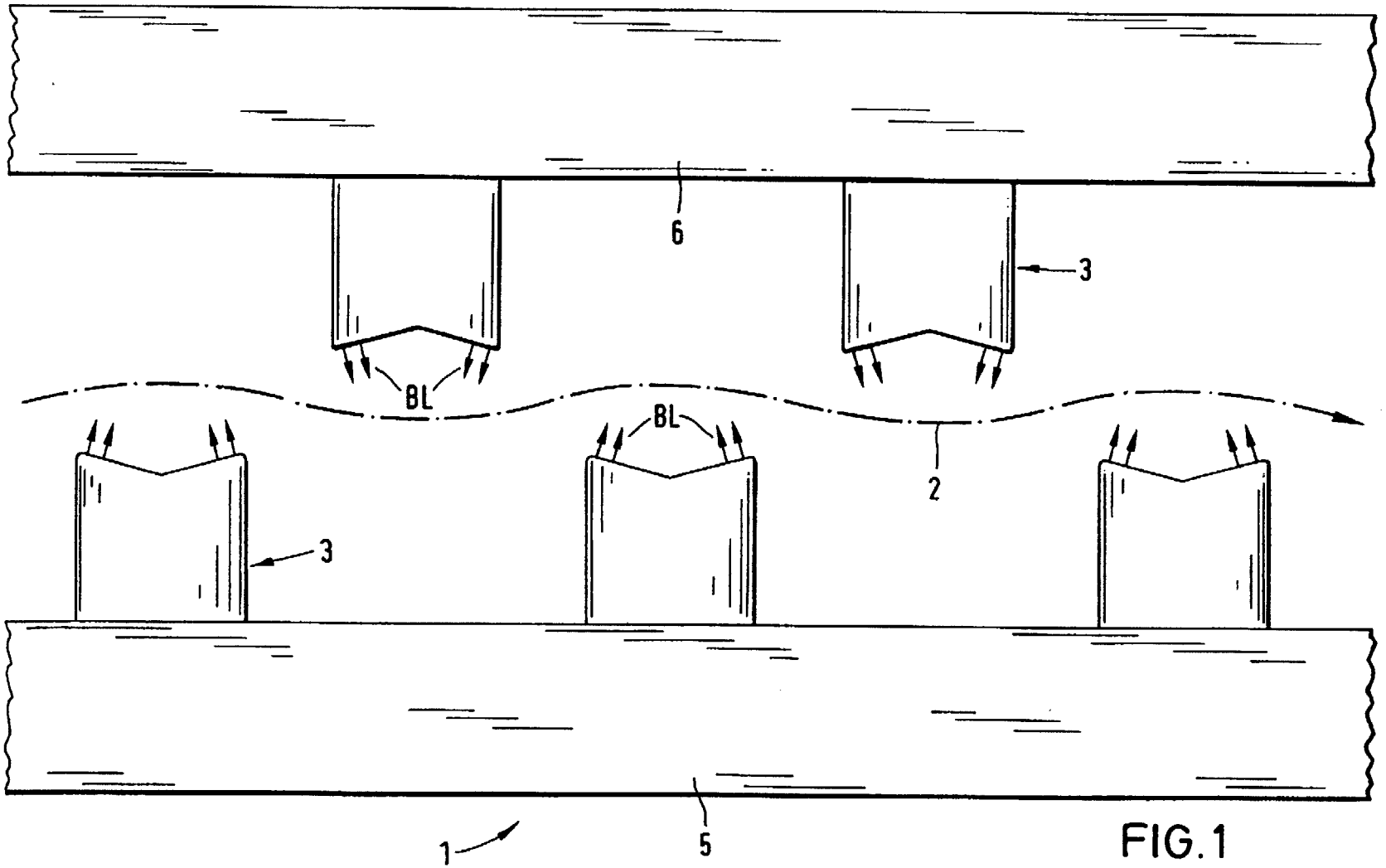
FIG. 1 is a schematic side view of an arrangement for the levitated guidance of a material web.

FIG. 1 of the drawing shows an arrangement 1 for the levitated guidance of a material web 2. The arrangement 1 includes a plurality of nozzle boxes 3 which are arranged above and below the material web 2 and spaced apart from each other in travel direction LR of material web 2. Blowing air BL is supplied to the nozzle boxes 3. As particularly shown in FIGS. 2 and 3, the nozzle boxes 3 have round blow nozzles 4. The blowing air BL is supplied to the nozzle boxes 3 through lines 5, 6. The blowing air is discharged through the round blow nozzles 4 and is blown against the material web 2.

Figure 2:
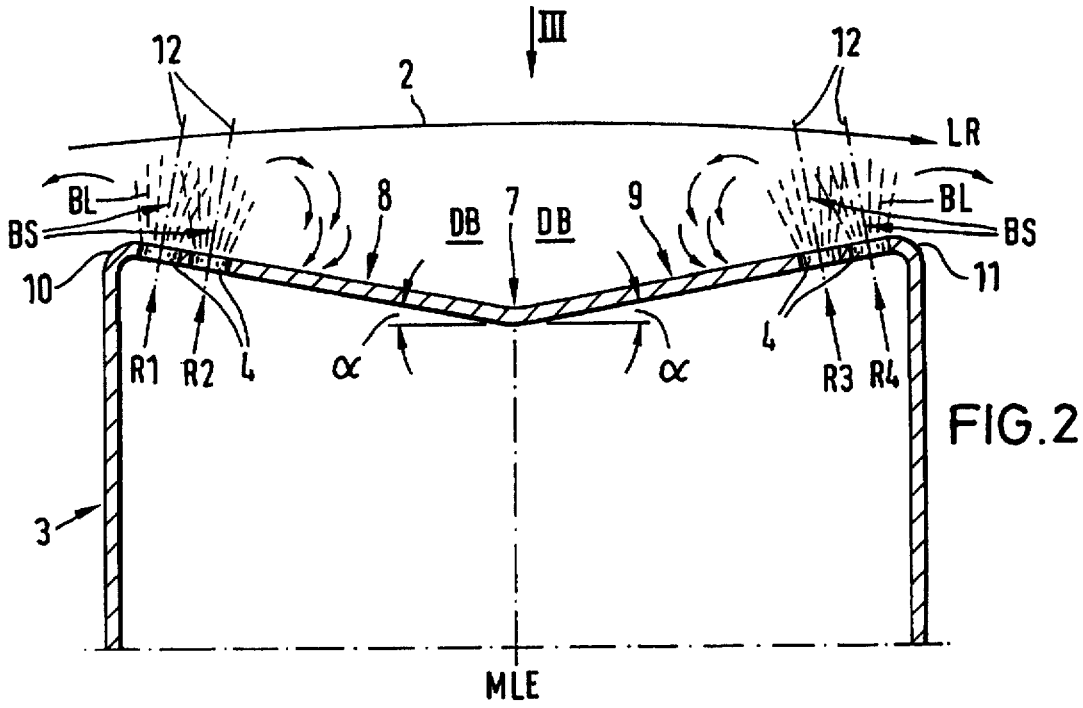
FIG. 2 is a vertical cross section, on a larger scale, of a nozzle box taken along sectional line II—II of Fig.
Figure 3:
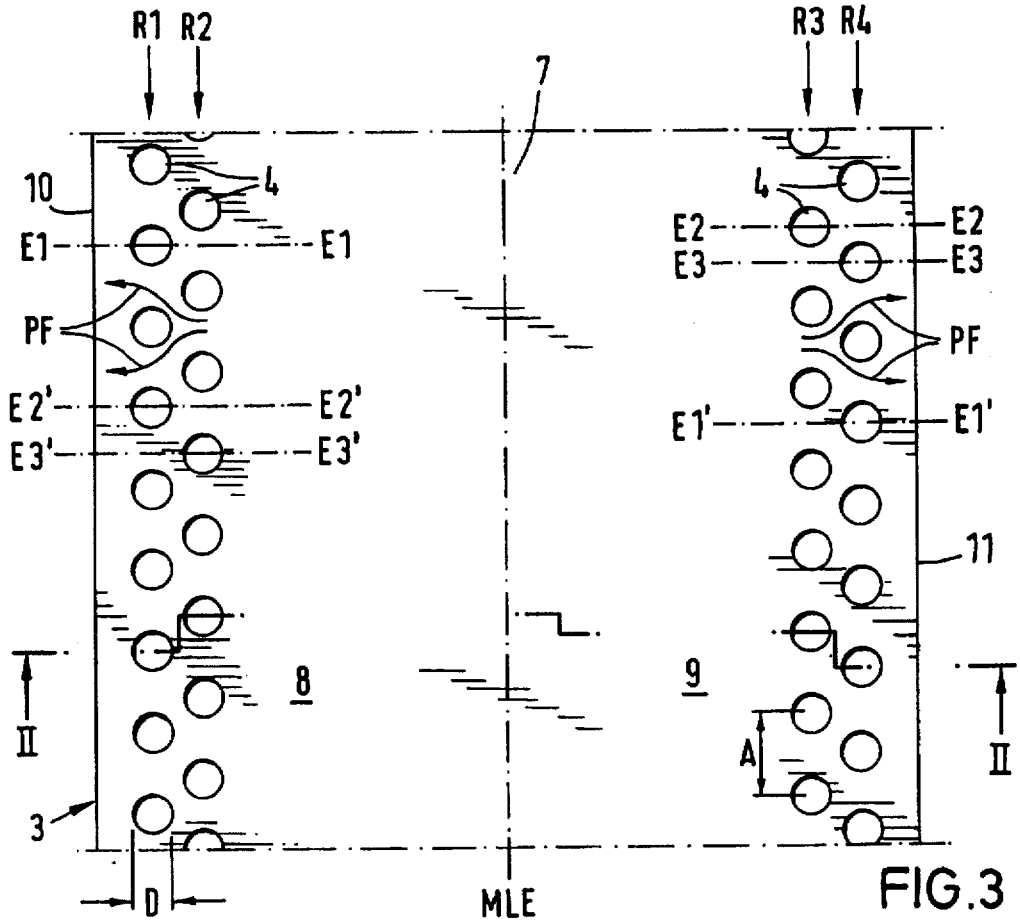
FIG. 3 is a top view of a portion of the nozzle box of FIG. 2 seen in the direction of arrow III.

As particularly illustrated in FIGS. 2 and 3, each nozzle box 3 which is formed of thin folded sheet metal has a V-shaped trough-like nozzle plate 7 which faces the material web 2. The two surface portions 8, 9 of the nozzle plate 7 extending from the vertical longitudinal center plane MLE of the nozzle box 3 are plane and extend at an angle $\alpha$ of 10° relative to the horizontal.

Two pairs of rows of nozzles R1, R2 and R3, R4, with round blow nozzles 4 are formed directly in the plane surface portions 8, 9 adjacent the two curved longitudinal edges 10, 11 of the nozzle plate 7. The axes 12 of the round blow nozzles 4 extend perpendicularly to the surface portions 8, 9. The rows of openings R1–R4 are provided in the surface portions 8, 9 in such a way that the rows of openings R2, R3 facing away from the longitudinal edges 10, 11 are closer to the longitudinal edges 10, 11 than to the longitudinal center plane MLE.

Figure 4:
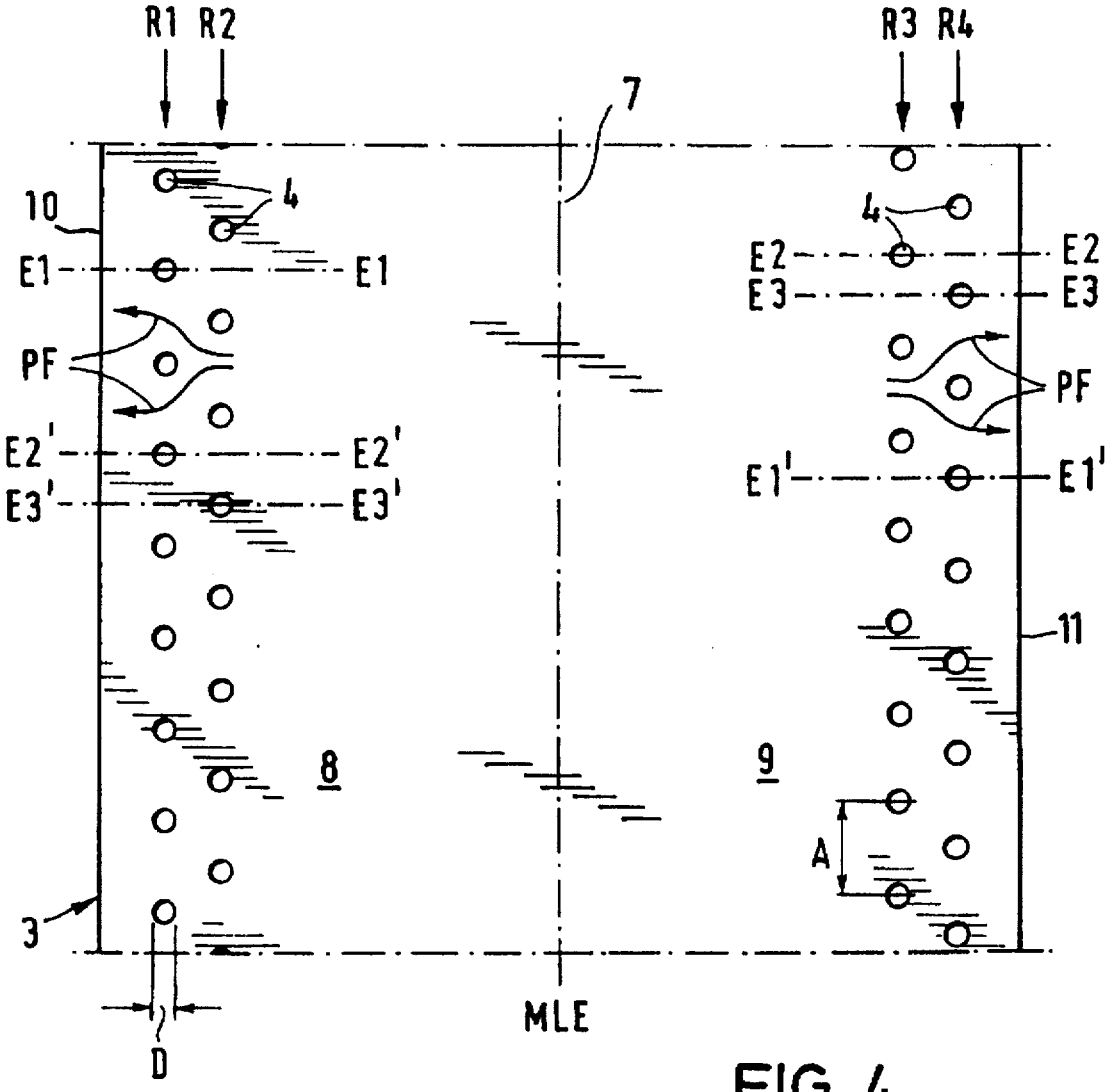
FIG. 4 is a top view of a portion of another embodiment of the nozzle box.

As shown in FIG. 4, the distance A between two round blow nozzles 4 following each other in a row of openings R1–R4 corresponds approximately three to five times, preferably four times the diameter D of the round blow nozzles 4.

The round blow nozzles 4 in the four rows of openings R1–R4 are arranged relative to each other in such a way that the round blow nozzles 4 of the row R1 located immediately adjacent the longitudinal edge 10 are each located in a vertical transverse plane E1—E1 which is located between two vertical transverse planes E2—E2, E3—E3 in which a round blow nozzle 4 each is provided in the rows of openings R3, R4 next to the other longitudinal edge 11.

The same relative positions are true for the round blow nozzles 4 provided in the row of openings R4 located immediately adjacent the other longitudinal edge 11 relative to the round blow nozzles 4 in the rows of openings R1 and R2. Thus, the transverse plane E1'—E1' is located between the transverse planes E2'—E2' and E3'—E3'.

As is further apparent from FIGS. 2 and 3, the blowing air BL discharged from the round blow nozzles 4 is directed against the material web 2 and is deflected at the material web 2 against the travel direction LR of the material web 2, as far as the round blow nozzles 4 arranged in the rows of openings R1, R2 are concerned, and in travel direction LR, as far as the round blow nozzles 4 arranged in the rows of openings R3, R4 are concerned. In addition, the trough-shaped nozzle plate 7 and the material web 2 form a diffuser-like space DB which widens from the rows of openings R1, R2 and R3, R4, respectively, toward the vertical longitudinal center plane MLE. The blowing air BL can enter this space DB in which it becomes intensely turbulent, and the blowing air can then be discharged between the bottom areas of the cone-like blowing columns BS as indicated by arrows PF in FIG. 3.

The invention is not limited by the embodiments described above which are presented as examples only but can be modified in various ways within the scope of protection defined by the appended patent claims.

I claim:

1. An arrangement for the levitated guidance of a material web traveling in a travel direction, the arrangement comprising a plurality of nozzle boxes arranged above and below the material web and at a distance between each other in travel direction of the material web, means for supplying blowing air to the nozzle boxes, each nozzle box having a nozzle plate facing the material web, each nozzle box having longitudinal edges extending transversely of the travel direction of the material web, the nozzle plate having two plane surface portions extending from the longitudinal edges and inclined relative to the horizontal to form a V-shape, two groups only of at least two rows of round blow nozzles for directing a blow jet against the material web, wherein both groups extend adjacent to and parallel with respective one of the longitudinal edges of each nozzle box, each nozzle box having a longitudinal vertical center plane, the round blow nozzles having axes extending perpendicularly to the plane surface portions, such that the direction of the blow jet is inclined relative to the vertical center plane of the nozzle box, wherein the round blow nozzles of one group of two rows adjacent each longitudinal edge are offset in longitudinal direction of the rows relative to the round blow nozzles of the other group of two rows, wherein each group of at least two rows of round blow nozzle includes a row located farthest away from the longitudinal edge, and wherein the row of round blow nozzles located farthest away from the longitudinal edge of the nozzle box is located closer to the longitudinal edge than to the vertical center plane of the nozzle box.

2. The arrangement according to claim 1, wherein the plane surface portions extend at an angle of 8° to 12° relative to the horizontal.

3. The arrangement according to claim 2, wherein the angle is approximately 10°.

4. The arrangement according to claim 1, wherein each group of rows has a row closest to a corresponding longitudinal edge and a row remote from a corresponding longitudinal edge, wherein each round blow nozzle of a row of round blow nozzles closest to the longitudinal edge is located between, in longitudinal direction, the round blow nozzles of a group of rows adjacent the opposite longitudinal edge of the nozzle box.

5. The arrangement according to claim 1, wherein the round blow nozzles arranged in each row are spaced apart from each other in longitudinal direction by a longitudinal distance, and wherein the round blow nozzles have a diameter, the longitudinal distance between round blow nozzles being three to five times the diameter of the round blow nozzles.

6. The arrangement according to claim 5, wherein the longitudinal distance between round blow nozzles is four times the diameter of the round blow nozzles.

* * * * *